US005277542A

United States Patent [19]

Nakanishi

[11] Patent Number: 5,277,542

[45] Date of Patent: Jan. 11, 1994

[54] TURBINE WITH SPIRAL PARTITIONS ON THE CASING AND ROTOR THEREOF

[76] Inventor: Yasuo Nakanishi, 61-1-202, Yamane-cho, Higashi-ku, Hiroshima-shi, Hiroshima, Japan

[21] Appl. No.: 936,734

[22] Filed: Aug. 31, 1992

Related U.S. Application Data

[62] Division of Ser. No. 623,544, Dec. 7, 1990.

[30] Foreign Application Priority Data

Dec. 9, 1989 [JP] Japan ..... 1-319588

[51] Int. Cl.[5] ..... F01D 1/06

[52] U.S. Cl. ..... 415/75; 415/74; 415/202

[58] Field of Search ..... 415/202, 73, 74, 75

[56] References Cited

U.S. PATENT DOCUMENTS

| | | | |
|---|---|---|---|
| 963,927 | 7/1910 | Oesterblom | 415/202 |
| 1,581,683 | 4/1926 | Nicholls | 415/74 |
| 2,084,667 | 6/1937 | Bell | 415/202 |
| 4,773,818 | 9/1988 | Mitsuhiro | 415/75 |

*Primary Examiner*—Edward K. Look

*Assistant Examiner*—Michael S. Lee

*Attorney, Agent, or Firm*—Young & Thompson

[57] ABSTRACT

With a turbine of the present invention, a preferably spiral partition is formed upright on the outer periphery of a rotor carried rotatably in a casing. A large number of blades are mounted between turns of the partition at a predetermined interval on the outer periphery of the rotor, and a channel for the working fluid is formed in the space between the blades and the partition on the outer periphery of the rotor.

Therefore, the turbine of the present invention is a highly efficient turbine capable of efficiently utilizing even a low pressure low speed low flow rate working fluid, while being capable of efficiently converting the kinetic energy of the working fluid into the rotational force of the rotor and realizing a low speed high torque rotation.

A turbocharger making use of the turbine is capable of performing sufficient supercharging not only during high speed rotation but during low speed rotation of the engine, while being preferably capable of cleaning emission gases.

5 Claims, 13 Drawing Sheets

TURBINE WITH SPIRAL PARTITIONS ON THE CASING AND ROTOR THEREOF

This application is a division of application Ser. No. 07/623,544, filed Dec. 7, 1990.

BACKGROUND OF THE INVENTION

1. Field of the Invention

This invention relates to a turbine and a turbocharger using the same and, more particularly, to a turbine provided with a rotor which is driven into rotation by a working fluid ejected from a nozzle and which may be used as a small-sized steam turbine, gas turbine or a turbocharger.

2. Description of the Prior Art

A turbine is constructed in general by a casing and a rotor rotatably carried in the casing and provided with a large number of blades on the circumference thereof, and is adapted for driving the rotor into a high-speed rotation by laterally discharging a gas at a high speed towards the blades from a nozzle provided on the casing. Each blade of the turbine is constituted by a concave surface generating a positive torque and a surface generating a negative torque so that a torque is produced which is the result of counterbalancing of the two torques.

Hence, with such conventional turbine, for producing a low-speed high-torque output, a rotor fitted with blades each having as large an outside radius as possible is set into a high-speed rotation and decelerated by a speed-reducing unit for producing a large rotational force, despite the fact that the problem is raised in connection with strength. Such conventional turbine is larger in size, while requiring a number of auxiliary devices, so that it tends to be expensive.

Thus a sufficiently high rotational force cannot be developed with the above described conventional turbine by simply reducing the size of the turbine and thereby reducing the costs. Besides, the space between the casing and the blades unavoidably leads to leakage of the unused working fluid and renders it difficult to raise the rotational force.

For improving the above described conventional turbine, a turbine has been proposed in the U.S. Pat. No. 4773818 in which a spiral flow of the working fluid is generated by a casing having a spirally extending groove on its inner periphery and a rotor having a spirally extending groove on its cuter periphery, and in which blades are provided at a predetermined interval within the spiral groove of the rotor.

With this improved type of the turbine, a low-speed high-torque output may be developed despite its small size. However, since the groove is formed on the inner peripheral surface within the casing, the working fluid, such as the steam, tends to leak through the spiral groove without contributing to the rotor revolutions, thus lowering the operating efficiency. In addition, the higher the number of revolutions of the rotor, the more the amount of the working fluid flowing through the spiral groove, due to the effect of a centrifugal force, thus lowering the turbine efficiency. Moreover, when the working fluid flows in the groove on the inner periphery of the casing, especially when it flows as it is forced towards the groove bottom under the effect of a centrifugal force, frictional losses are increased, thus further lowering the turbine efficiency.

BRIEF SUMMARY OF THE INVENTION

It is a principal object of the present invention to eliminate the above mentioned deficiencies of the prior art and to provide a turbine capable of developing a low-speed high-torque rotational force with a high efficiency even with the use of the low pressure or low speed working fluid or with a minor amount of the working fluid.

It is a further object of the present invention, in addition to the above principal object, to provide a turbine in which the amount of the working fluid which, after having been introduced into the turbine, is allowed to leak from the space between the rotor and the casing without imparting a rotational force to the rotor fins or blades, thereby reducing the amount of working fluid, and thus assuring an efficient conversion of the energy of the working fluid into the rotational force of the rotor.

It is a further object of the present invention to provide a turbine in which the high efficiency, low speed and the high torque according to the above mentioned principal object may be achieved by a simplified construction and low costs.

It is a further object of the present invention, in addition to the above principal object, to provide a turbine which may be assembled easily.

It is a further object of the present invention to provide a turbocharger which may be rotated perpetually efficiently to assure efficient supercharging both during the low speed rotation and the high speed rotation of an internal combustion engine.

It is a still further object of the present invention, in addition to the above objects, to provide a turbocharger capable of cleaning emission gases.

In the first aspect, the present invention provides a turbine comprising a casing, a rotor rotatably carried within said casing, a number of blades projectingly mounted at a suitable interval from each other on the outer periphery of said rotor, a channel formed on a circumference of the outer periphery of said rotor in adjacency to said blades, an inlet formed in said casing for introducing a working fluid into said channel and an outlet formed in said casing for introducing the working fluid through said channel to outside.

Preferably, said turbine further comprises a set of partitions which are projectingly mounted on both ends of the outer periphery of said rotor and said blades are provided within and between said partitions.

Preferably, said turbine further comprises a guide for directing said working fluid towards said blades which is arranged in said channel.

Preferably, said blades are arranged in two rows and said channel is defined therebetween.

Preferably, said casing is provided with a spiral channel formed on the inner periphery of the casing.

Preferably, the width of said channel of the casing is gradually narrow toward the foremost part of the casing along the rotor.

In the second aspect, the present invention provides a turbine comprising a casing, at least one partition projectingly formed on and extending spirally along the outer periphery of said rotor, a number of blades projectingly formed at a suitable interval from each other on the outer periphery of the rotor between turns of said partitions, a channel spirally formed on the circumference of the outer periphery of the rotor in adjacency to said blades, an inlet formed in said casing for introducing a working fluid into said channel and an outlet formed in said casing for discharging the working fluid flowing through said channel to outside.

Preferably, said blades are inclined with respect to said partition.

Preferably, one lateral side of each of said blades is secured to said partition.

Preferably, said blades are arrayed in one row between adjacent turns of said partition.

Preferably, said blades are arranged in two rows between adjacent turns of the partition.

Preferably, said blades are arrayed in one row between adjacent turns of said partition and said channel is provided on both sides of said blades.

Preferably, a guide plate for guiding said working fluid in a direction opposite to the rotational direction is further provided on the side of said rotor on which said working fluid is discharged.

Preferably, said partition and blades are reduced in diameter towards the foremost part of said rotor and said casing is reduced in diameter in keeping with said partition and said blades.

Preferably, said inlet is provided centrally along the longitudinal direction of said casing, wherein said outlet is provided at both ends in the longitudinal direction of said casing, and wherein the partition provided on the outer periphery of said rotor is anti spiral from each end of the longitudinal direction towards the center of the partition.

Preferably, said inlet is provided at both ends in the longitudinal direction of said casing, said outlet is provided centrally along the longitudinal direction of said casing, and the partition provided on the outer periphery of said rotor is anti-spiral from the center of the partition towards each end of the longitudinal direction Preferably, said rotor is tubular, a spirally extending partition is provided on the inner periphery of said rotor, a number of blades are projectingly provided at a suitable interval on the inner periphery of the rotor between adjacent turns of said partition, and wherein a channel is formed on the circumference on the inner periphery of said rotor in adjacency to said blades.

Preferably, said casing is of a hermetically sealed construction.

Preferably, said casing is provided with an anti-spiral channel defined between adjacent turns of partition formed on the inner periphery of the casing against the spiral partition projectingly formed on said rotor.

Preferably, the width of said channel of the casing is gradually narrow toward the foremost part of said casing along the rotor.

In the third aspect, the present invention provides a rotatably mounted rotor, a spiral partition projectingly formed on the outer periphery of said rotor, an annular casing fittingly secured to said partition so as to be unified with said rotor, a plurality of blades secured to at least one of said rotor, partition and the casing and provided at a suitable interval on the outer periphery of the rotor, a channel formed in a spiral pattern on the circumference of the outer periphery of said rotor adjacent to at least one of the upper and lower ends and the left and right sides of the blades, a side plate mounted on one side of the rotor with a suitable clearance from the rotor and surrounding the space between the rotor and the casing from the lateral side, an inlet formed in said side plate for introducing a working fluid and an outlet formed in said side plate for discharging the working fluid.

In the fourth aspect, the present invention provides a turbine comprising a pair of disks, a spiral passageway formed by a helically extending partition interconnecting said disks with a suitable interval therebetween, a plurality of blades secured at a suitable interval toward the center at least one of said disks and the partition, a channel formed along said passageway in adjacency to at least one of the upper and lower ends and the left and right sides of said blades, an opening formed in communication with said channel at an axial center of one of said disks for introducing or discharging said working fluid, and a rotary shaft secured to an axial center of the other of said disks.

Preferably, the turbine is fitted in a casing and adapted for rotating in said casing.

In the fifth aspect, the present invention provides a turbine comprising a casing, at least one partition projectingly formed along the inner periphery of said casing, a plurality of concave portions formed at a suitable interval on the inner periphery between adjacent turns of said partition, a rotor rotatably carried within said casing, at least one partition projectingly formed along the outer periphery of said rotor, a plurality of blades formed by a plurality of concave portions provided at a suitable interval on the outer periphery of said rotor between adjacent turns of said partition, an inlet formed in said casing for introducing a working fluid into said casing and an outlet formed in said casing for discharging said working fluid out of said casing.

Preferably, the partition of said casing and the partition of said rotor are both spiral.

Preferably, the spiral partition of the casing and the spiral partition of the rotor are the reverse direction with each other.

Preferably, said casing is further provided with a plurality of nozzles for flowing said working fluid to said blades.

Preferably, the width of a channel defined between adjoining turns of the partition of said casing is equal to the width of the partition of said rotor.

Preferably, the partition of said casing is of the same shape as the partition of said rotor.

Preferably, a plurality of partitions are provided between two partitions of said casing associated with adjoining partitions of said rotor.

In the sixth aspect, the present invention provides a turbine comprising a casing, a rotor rotatably carried in said casing, a partition or partitions projectingly formed on the outer periphery of said rotor for defining a channel meandering in alternate directions at a predetermined interval along the outer periphery of said rotor, an inlet formed in said casing for introducing a working fluid into said channel and an outlet formed in said casing for discharging said working fluid flowing in said channel.

Preferably, said channel is zigzag-shaped or corrugated.

Preferably, said channel is formed spirally along the outer periphery of said rotor.

Preferably, said partition or partitions and said channel are of the same shape.

Preferably, a partition or partitions are formed on the inner periphery of said casing for defining a channel (a groove) along the inner periphery of said casing, and said channel is meandering in alternate directions at a predetermined interval.

Preferably, the channel of said casing and the partition or partitions are of the same shape as the channel of said rotor and said partition or partitions.

Preferably, the channel of said casing and the channel of said rotor are of the spiral form directing reversely with each other.

In the seventh aspect, the present invention provides a turbine comprising a drum, a supporting shaft connected to the center of at least the lateral sides of said drum, a casing surrounding the outer periphery of said drum and carried by said supporting shaft, at least one partition projectingly formed on the inner periphery of said casing, blades projectingly formed at suitable intervals on the inner periphery of said casing between adjoining turns of said partition, a channel formed adjacent to said blades on the circumference of the inner periphery of said casing, an inlet formed in said drum through said supporting shaft for introducing a working fluid into said channel and an outlet formed in said drum through said supporting shaft for discharging the working fluid flowing in said channel to outside.

Preferably, said partitions and said channel are spiral on the inner periphery of said casing.

In the eighth aspect, the present invention provides a turbocharger comprising a turbine using emission gases of an internal combustion engine as the working fluid according to abovement aspects, a blower mounted on the other end of a rotary shaft of said rotor and a blower casing surrounding said blower and having an inlet and an outlet for sucking or discharging a charging gas mixture.

Preferably, part or all of the channel of said turbine is constituted by one or more of a catalytic material, a material with a catalyst deposited thereon or a catalyst-containing material.

BRIEF DESCRIPTION OF THE DRAWINGS

FIG. 27 is a longitudinal cross-sectional view of a casing of a turbine shown in FIG. 11.

FIG. 28 is a longitudinal cross-sectional view of a casing of a turbine shown in FIG. 21.

DETAILED DESCRIPTION OF THE INVENTION

Figure 2:
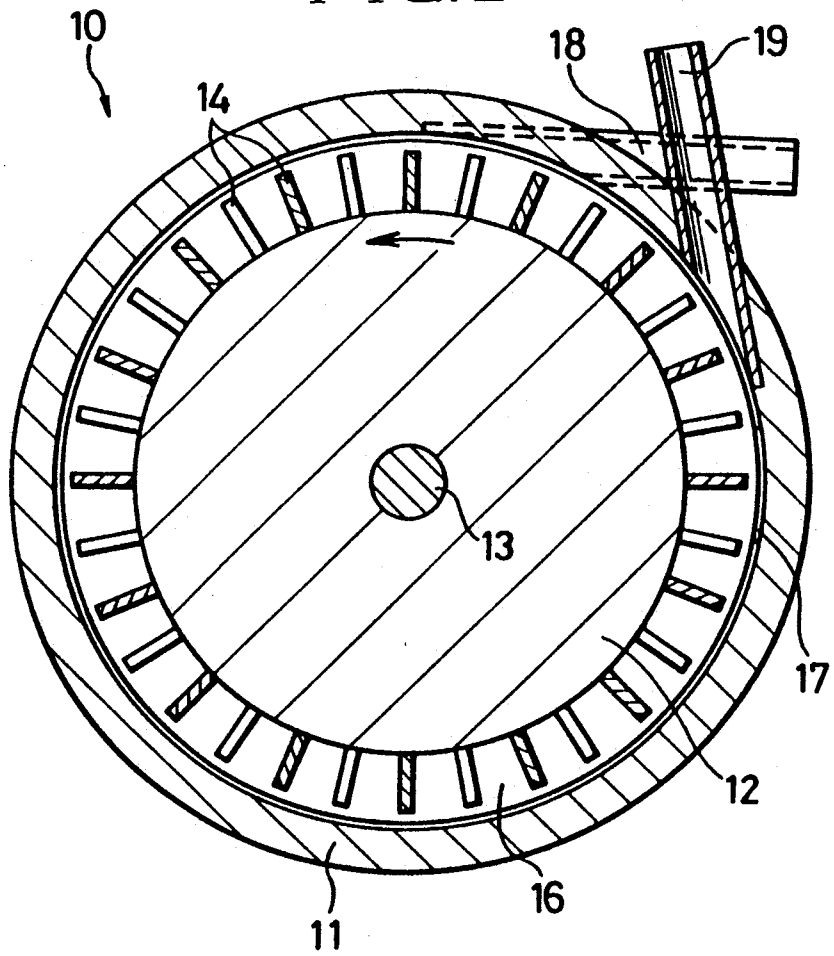
FIG. 2 is a view looking in the directions of arrows II—II in FIG. 1.

A turbine according to the present invention will be hereinafter explained in detail.

In the first aspect of the turbine according to the present invention, a large number of blades and a channel adjacent to these blades are formed on a rotor rotatably carried within a casing. The working fluid flowing through the channel strikes on the blades sequentially to shift the blades to rotate the rotor. Even if the force applied to each blade is small, a larger force is produced by the working fluid impinging on a large number of the blades to develop a large rotational torque. When the load causing the rotation of the rotor is increased, the opposition from the blades is increased to develop a larger torque.

If the load is so large as to impede the rotation of the rotor, the working fluid is discharged via channel by way of the discharge port.

In the second aspect of the turbine according to the present invention, a spirally extending channel is formed by a spirally extending partition on the outer periphery of the turbine and a large number of blades are provided in the channel.

With this turbine, the working fluid is discharged after several revolutions around the rotor to utilize the kinetic energy of the working fluid more effectively.

With each of the above mentioned turbines, the casing need not be machined on its inner periphery, and accounts for about one-fourth of the cross-sectional area of the channel, so that only a minor amount of the working fluid is in contact with the casing. As a result, the frictional losses caused by frictional contact with the casing are reduced, so that the majority of the kinetic energy proper to the working fluid contributes to rotor rotation.

In another embodiment of this aspect of the turbine of the present invention, a spiral groove extending in one direction is formed on the outer periphery of the rotor, while a spiral groove extending in the opposite direction is formed on the inner periphery of the casing, and blades are provided in the spiral groove on the outer periphery of the rotor. With this turbine, the working fluid is returned to the inlet side by way of the spirally extending groove on the casing for increasing the static pressure. On the other hand, the amount of the working fluid discharged via spirally extending groove in the casing is reduced or substantially nil, so that the working fluid may be utilized more effectively to increase the rotational force of the rotor.

In a third aspect of the turbine, the rotor and the casing are connected and unified to each other by a partition of a spirally extending groove and a stationary plate laterally enclosing the space between the rotor and the casing is provided on one side, while a nozzle for ejecting the working fluid is provided on the stationary plate. With this turbine, the casing is unified with the rotor, so that the force of rotation of the rotor is enhanced due to the frictional resistance of the rotor with the casing.

If the spirally extending channel is provided in the above described turbines, the casing is formed as a cylinder having an open top broader than the bottom, while a spirally extending partition having a height progressively lesser along the length thereof is formed on the outer periphery of an axial or tubular rotor fitted to the casing. After fitting the rotor, a lid is applied. With this turbine, attachment and dismounting for inspection or repair may be facilitated, while the channel becomes progressively narrow towards the discharge side without causing pressure drop.

In a fourth aspect of the turbine, a pair of disks are connected together by a spirally extending partition, and a large number of blades are provided within the thus defined spirally extending channel. A rotational shaft is secured to the axial center of one of the disks and a nozzle or a discharge port is provided at the axial center of the other disk. With this turbine, the working fluid introduced by a nozzle provided at the channel end on the outer periphery of the turbine is caused to flow spirally to be discharged at the discharge port at the axial center, or alternatively, the working fluid introduced at the nozzle provided at the axial center is discharged at the outlet provided at the end of the channel on the outer periphery of the turbine. At any rate, as long as the working fluid remains in the turbine, it impinges on the blades in the channel to rotate the rotor.

In a fifth aspect of the turbine, alternate projections and recesses in the form of serrations, gear teeth, inundations or curvatures are provided along the circumference on the outer periphery of the rotor, while nozzles are provided in those portions of the casing where spacings are formed by concave portions. When the convex portions of the rotor register with the convex portions of the casing, the pressure of the working fluid introduced into the spacings delimited by the concave portions is increased to rotate the rotor.

When the convex portion of the rotor are moved away from the convex portions into register with the concave portions of the casing, a channel connecting to the discharge opening is formed on the outer periphery of the rotor.

In another embodiment of this aspect of the turbine, alternate projections and recesses are formed on the inner periphery of the casing and on the outer periphery of the rotor. In this case, the channel on the casing registers with the channel on the rotor for each complete revolution of the rotor, with the convex portions of the rotor registering with the convex portions of the casing at one or more positions.

Hence, in this case, a nozzle is provided in each adjoining channel.

In a sixth aspect of the turbine, zigzag-shaped or corrugated projections are formed on the inner periphery of the casing, while zigzag-shaped or corrugated recesses are formed on the outer periphery of the rotor, so that, when the recesses or concave portions are stopped up by the projections or convex portions by rotor rotation, the pressure of the working fluid introduced into the casing is increased and, when the concave portions clear the convex portions, the working fluid flows into the concave portions to rotate the rotor.

In another modification of the turbine, zigzag-shaped or corrugated projections are formed spirally on the inner periphery of the casing, whereas recesses or concave portions are formed spirally on the outer periphery of the rotor. With this turbine, the recesses on the rotor are stopped up with the projections on the casing once for each complete revolution of the rotor and a difference is caused between the pressure in the concave portion of the rotor and that in the concave portion of the casing. When, as a result of rotor rotation, the concave portions of the rotor communicates with the concave portion of the casing, the high pressure working fluid flows into the concave portions in the rotor to cause rotor rotation.

In each of the above described turbines, the rotor is adapted to rotate within the casing. However, according to the turbine of the seventh aspect of the present invention, the casing is adapted to rotate around a stationary rotor. In this case, the blades are mounted on the inner periphery of the casing, and the working fluid is introduced from a nozzle provided on the rotor.

In each of the above described turbines, air, steam, combustion gases or emission gases are usually employed as the working fluid. However, any other fluids, such as freon gas, water or the like may also be employed.

One of the desirable usages of the turbines is the turbocharger according to the eighth aspect of the present invention, in which case the working fluid proves to be emission gases. When the turbine is used as a turbocharger, for removing carbon monoxide (CO), unburnt hydrocarbon (HC) and nitrogen oxides (NOx) in the emission gases, it is preferred to provide a suitable catalyst, such as platinum (Pt) or palladium (Pd), or oxides of transition metals, such as copper (Cu), chromium (Cr), nickel (Ni) or manganese (Mn), or copper-nickel alloys, on a part or all of the channel, to form the outer periphery of the rotor or the blades, the inner periphery of the housing or other portions in contact with the working fluid by the above described catalyst, or to apply a catalyst layer on the surface of the contact portions.

In the following, various modes or aspects of the turbine and turbocharger according to the present invention will be explained in detail with reference to preferred embodiments thereof shown in the accompanying drawings.

Figure 1:
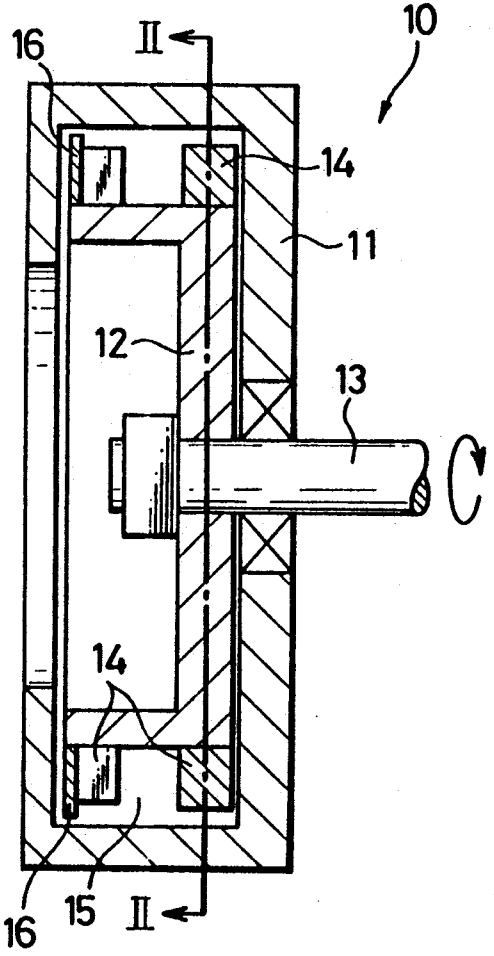
FIG. 1 is a longitudinal cross-sectional view of an embodiment of a turbine according to the present invention.

FIG. 1 is a longitudinal cross-sectional view showing an embodiment of the turbine according to the present invention; and FIG. 2 is a view taken along arrows II—II in FIG. 1.

Figure 3:
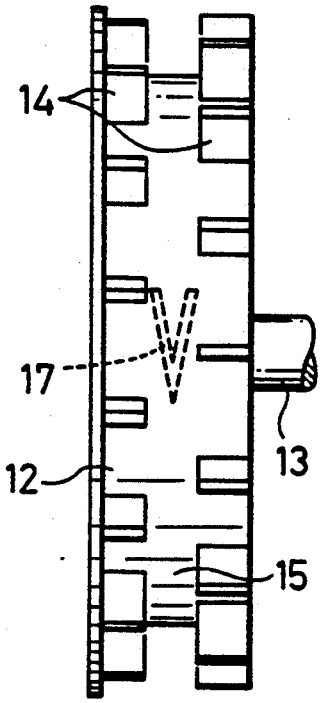
FIG. 3 is a front view of a rotor employed in a turbine shown in FIG. 1.

As shown in these figures, a turbine 10 according to a first aspect of the present invention is composed of a casing 11 having a substantially C-shaped cross-section, and a rotor 12 having a substantially C-shaped concave cross-section, this rotor 12 being disposed in said casing 11 and rotatably fulcrumed within the casing 11 by a rotational shaft 13. AS shown in FIGS. 1 to 3, a large number of fins or blades 14 are implanted in a left side row and a right side row on the outer periphery of the rotor 12 at a constant circumferential interval, so that the left side fins or blades are staggered with respect to the right side fins or blades, the central portion functioning as a channel 15 for a working fluid.

If one of the lateral sides of the casing 11 is opened, as in the illustrated embodiment, a partition 16 is preferably implanted on the outer periphery of a terminal portion of the rotor 12. It is because the working fluid may be prevented in this manner from leaking from a gap between the blade 14 and the casing 11. In the illustrated embodiment, the blades 14 can be affixed to the partition 16 to desirably raise the rigidity of the blades 14, It is preferred to provide partitions on both ends of the rotor 12 so that the blades 14 may be provided within the interior of the casing. However, the partition may be omitted if a lid is provided on the open side of the casing 11 in FIG. 1 for hermetically sealing the casing 11.

A vee shaped guide 17 is provided in the channel 15 for projecting from the inner peripheral surface of the casing 11 (see FIG. 3). Although only one guide 17 is shown in the present embodiment, a plurality of such guides 17 may also be provided at a predetermined interval along the circumference of the casing 11. The function of the guide or guides 17 is to deviate the working fluid towards left and right for impingement on the left and right fins and to stop the flow of the working fluid from the reverse direction.

The casing 11 is provided with an inlet opening or nozzle 18 for introducing the working fluid, a discharge port 19 for the working fluid, an opening, not shown, for passage of cooling water for cooling the casing 11, and an opening connecting to a valve for adjusting the pressure and the flow rate of the working fluid within the casing 11. Although there is no limitation to the mounting positions of the nozzle 18 or the discharge port 19, they are preferably provided so that the working fluid may perform sufficient work on the blades 14. The nozzle 18 and the discharge port 19 are also preferably oriented along the tangential direction of the rotor 12.

The opening of the nozzle 18 may be provided at any positions on the peripheral surface of the casing 11 upstream of the distal end on the pointed side of the guide 16. However, the opening of the nozzle 18 is preferably at the center along the longitudinal direction of the casing 11. Although only one nozzle 18 is provided on the periphery of the casing 11 in the present embodiment, a plurality of nozzles 18 may also be provided at a predetermined interval from each other.

Although the discharge port 19 may also be provided at any position on the peripheral surface of the casing 11 downstream of the rear end of the guide 16, it is preferred that the opening of the discharge port 19 face the blades 14 in order to permit the working fluid to be discharged to outside after the working fluid has done the work on the blades 14 for converting the energy thereof into the rotational force of the rotor 12. Since the blades 14 are provided in two rows in the illustrated embodiment, two discharge ports 19 may be provided on the same peripheral surface of the casing 11 for facing the blade rows. However, only one discharge port 19 may be provided in association with one of the blade rows. Although only one position on the peripheral surface of the casing is provided in the present embodiment for providing the discharge port 19, this is not mandatory and a plurality of such positions may be provided at a predetermined interval from one another, as in the case of the nozzle 18.

Figure 4B:
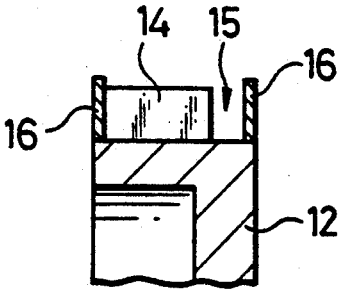
FIGS. 4*a* and 4*b* are partial cross-sectional views of a modification of a rotor employed in a turbine according to the present invention.
Figure 4A:
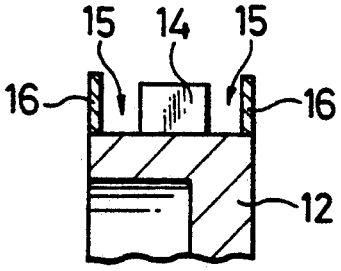

In the above described embodiment, the channel 15 is provided centrally of the rotor 12 and the blades 14 are provided in two rows on both sides of the channel. However, as shown in FIG. 4*a*, partitions 16 may also be provided on both ends of the rotor 12 and a row of blades 14 may be projectingly formed at the center of the rotor 12 so that a pair of channels 15 are formed between the blades and the both side channels. Alternatively, as shown in FIG. 4*b*, the blades 14 may be affixed on one lateral sides thereof to one of the partitions 16 and a space between the blades and the other partition 16 may be used as a channel. In these cases, a guide or guides 17 in the form of inclined plates inclined with respect to the flowing direction may be used in place of the vee guide or guides.

In the above described embodiment, the blades 14 are flat and of same size. In addition, the blades extend at right angles to the flowing direction and the left side and right side blades are staggered relative to each other. Alternatively, the blades may be comprised of longer and shorter blades or larger and smaller blades, vee shaped or curved, or may be inclined or curved back and forth with respect to the flowing direction. When the blades are formed in the form of orifices, the orifice-shaped openings in the blades may function as the channels, without providing a channel or channels at the center or at one or both ends. Although the blades 14 are provided in the above embodiment in a staggered relation on the left and right sides to produce a large resistance to the flow, the blades on the left and right sides may also be provided in register with one another.

In the above described embodiment, the lateral sides of the casing 1 may be formed as lattices, if necessary, to permit circulation of cold air, or the outer lateral sides of the rotor 11 may be provided with upstanding blades to improve the cooling effect of the rotor. The casing 1 may be provided with the groove (the channel) at its inner peripheral surface. The groove may also be of a spiral form having a width progressively narrow towards the foremost part of the groove. Furthermore, the turbine according to the first aspect is capable of forming the structure of multi-stage turbines, so that a highly improved turbine can be obtained.

Figure 5:
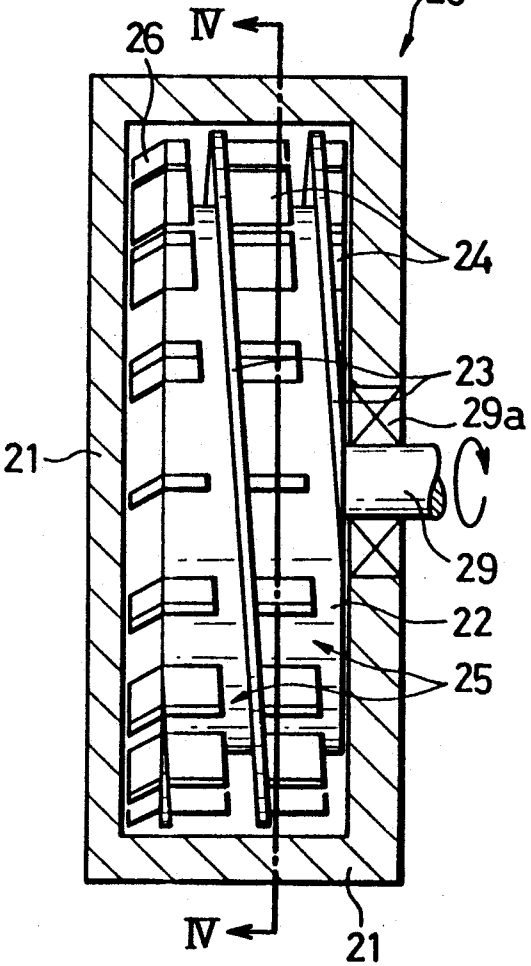
FIG. 5 is a longitudinal cross-sectional view showing a further modification of a turbine according to the present invention.

FIGS. 5. and 6 illustrate a second aspect of a turbine 20 of the present invention wherein a spirally extending partition 23 is provided on the outer peripheral surface of a rotor 22 arranged within the casing 21 to form a spirally extending passageway and blades 24 are fitted at a predetermined interval on one side of the partition while the other side of the partition function as the channel 25. On the discharge side of the rotor, there are provided guides 26 on the blades for guiding the working fluid in a direction reverse to the rotational direction of the rotor 22. Although a plurality of guides 26 are provided in the present embodiment, only one guide 26 suffices.

The turbine of the embodiment described below has basically the same structure as the turbine of the first embodiment of the turbine shown in FIGS. 1 to 3, except that the spiral partition is provided on the outer periphery of the rotor and plural blades are provided between turns of the partitions to define a spirally extending channel. Therefore, the description is made only of the different portions, while the detailed description of the similar portions is omitted.

An inlet 27 for introducing the working fluid and an outlet 28 for discharging the working fluid are provided at suitable positions of the casing 21 for extending in the tangential direction of the rotor 22. In the present embodiment, the inlet 27 is provided at the right side end along the longitudinal direction of the casing 21 of FIG. 5, whereas the outlet 28 is provided at the opposite end thereto.

The positions of the inlet 27 and the outlet 28 may be suitably selected as a function of the contour of the channel 25 and the blades 24 provided on the outer periphery of the rotor 22.

The rotor 22 is carried on the casing 21 by a rotary shaft 29 by means of a bearing 29*a*.

Figure 7A:
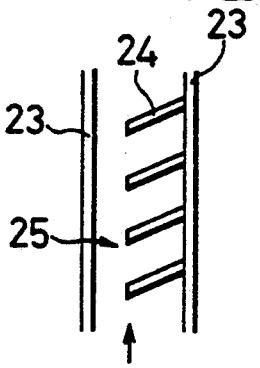
FIGS. 7*a*, 7*b*, 7*c* and 7*d* are developed views, taken along the outer periphery of the rotor, and showing various mounting states of the blades projectingly mounted on the outer periphery of the rotor employed in the present invention.
Figure 7B:
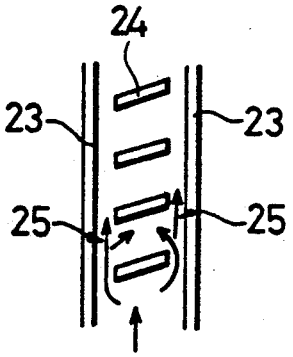
Figure 7C:
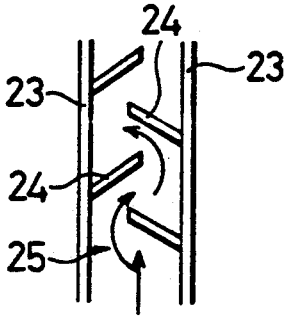
Figure 7D:
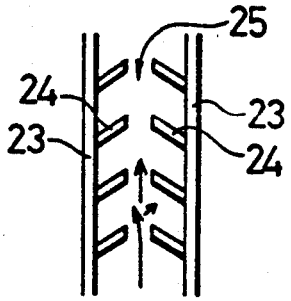
Figure 6:
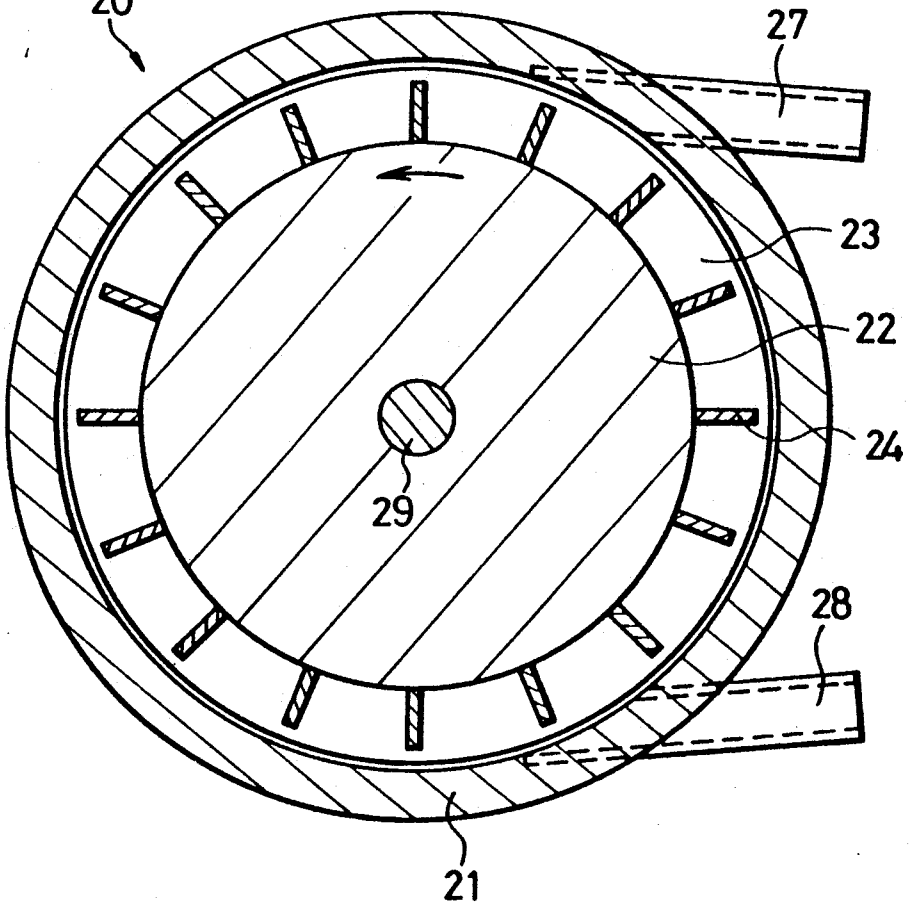
FIG. 6 is a transverse cross-sectional view thereof.

Meanwhile, in the present invention, there is no specific limitation to the mounting position or orientation of the blades 24 on the partition 23 or to the method of forming the channel 25. Thus, as shown in developed views of FIGS. 7*a* to 7*d* along the partition 23 and the outer periphery of the rotor 22, various mounting positions or orientations or the forming methods may be employed. As shown in FIG. 7*a*, the blades 24 may be affixed in a row to the partition 23 at an inclination relative to the partition 23, with the other side of the blade row functioning as the channel. Although not shown, the blades 24 may be mounted with an inclination in the opposite direction, or may be mounted upstandingly. Also, as shown in FIG. 7*b*, the blades 24 may be provided centrally between the turns of partition 23, with both sides of the blades functioning as the channel 25. Alternatively, as shown in FIG. 7*c*, the blades may be provided for extending from both side partitions 23 at a predetermined interval in a staggered relation beyond the centerline between the partitions 23 so that the channel 25 extends in a meandering or zigzag manner. Still alternatively, as shown in FIG. 7*d*, two rows of blades 24 may be provided from both side partitions 23 so that the channel 25 may be defined between the both side partitions 23.

Figure 8:
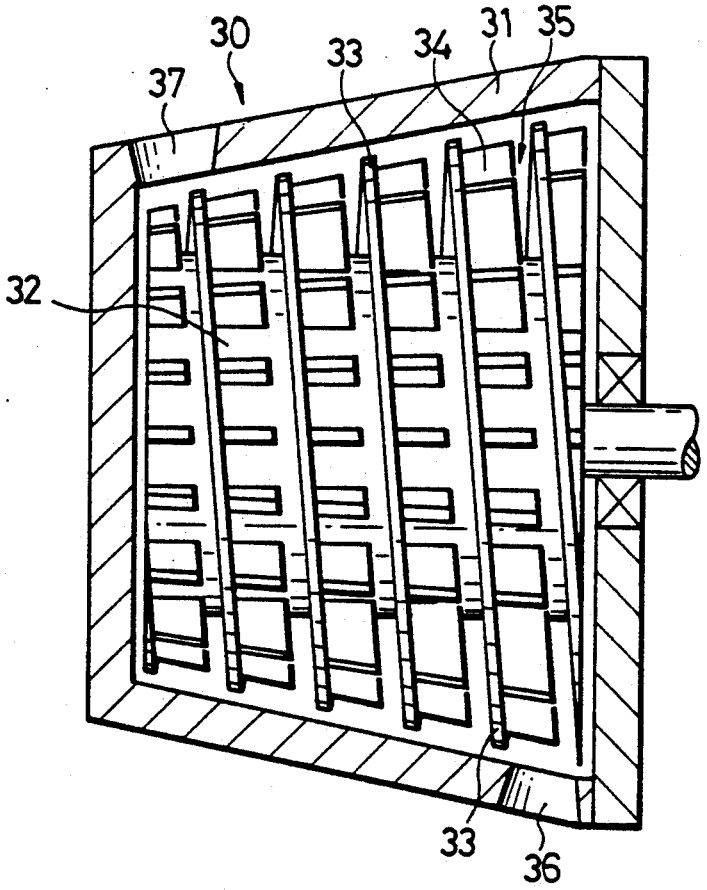
FIG. 8, 9, 10 and 11 are longitudinal cross-sectional views showing respective modifications of a turbine according to the present invention.

FIG. 8 shows another preferred embodiment of the present invention wherein of a conical turbine 30 a casing 31 is conical and tapered towards the distal end and wherein a partition 33 and blades 34 projectingly formed on the outer periphery of a rotor 32 arranged in the casing 31 are tapered towards the distal end of the rotor 32. This conical turbine 30 may be easily assembled because the casing 31 and the partition 33 of the rotor 32 (with the blades 34) are tapered towards the distal end. Thus the interval between the casing 31 and the rotor 32, above all, the partition 33, may be reduced to the minimum to reduce the leakage of the working fluid to improve the utilization efficiency of the working fluid.

With the conical turbine 30, the channel 35 is defined between the partition 33 and the blades 34 both of which are tapered towards the distal end, so that the channel becomes narrower towards the distal end and hence the majority of the working fluid is guided towards the rotor 32 to perform work on the blades to contribute to the revolutions. Although there is no limitation to the specific positions for the inlet and the discharge port of the working fluid, it is preferred that the inlet 36 and the discharge port 37 be provided at the larger diameter side and at the lesser diameter side, respectively. Thus the ultimately unused working fluid which is not utilized for revolutions of the rotor 32 may be minimized.

Figure 9:
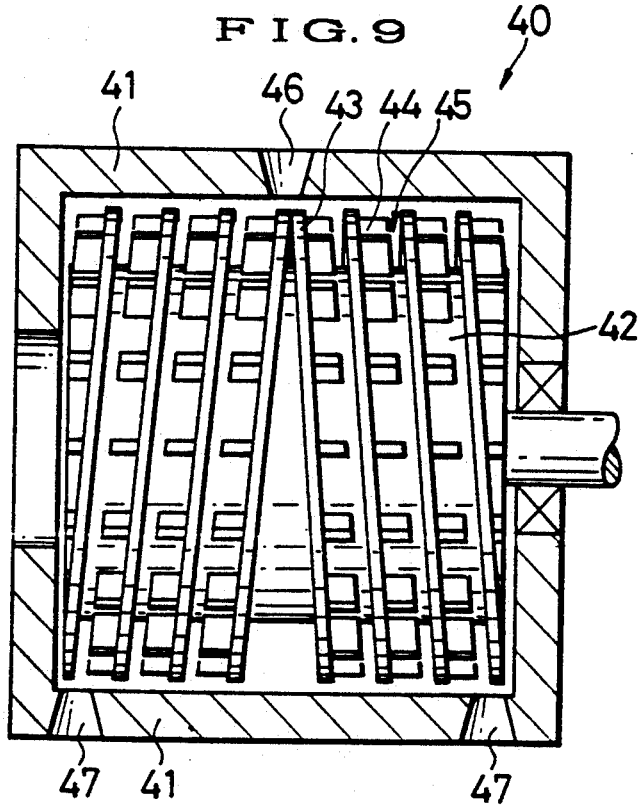

In a turbine 40 according to a modification of the above described embodiment, as shown in FIG. 9, an inlet (nozzle) 46 for the working fluid is provided at the middle along the longitudinal direction of a casing 41; discharge ports 47, 47 for the working fluid provided at both ends along the same direction of the casing 41, a partition 43 on the outer periphery of a rotor 42 is formed in an anti-helical pattern from a position in register with the inlet 46, that is a mid position along the longitudinal direction of the rotor 42, towards both ends, plural blades 44 are provided at a predetermined interval between the turns of the partition and a channel 45 is provided between the partition 43 and each blade 44.

With the above described turbine 40, since the channel 45 is anti-helical (anti-screw) from the center towards both ends of the rotor 42, the ultimately unused working fluid not contributing to rotor rotation may be prevented from leaking from the casing.

Although the inlet 46 and the discharge ports 47, 47 may be reversed with the turbine 40 shown in FIG. 9, it is preferred, for preventing the leakage of the ultimately unused working fluid, to provide the inlet at the center along the longitudinal direction of the casing.

Figure 10:
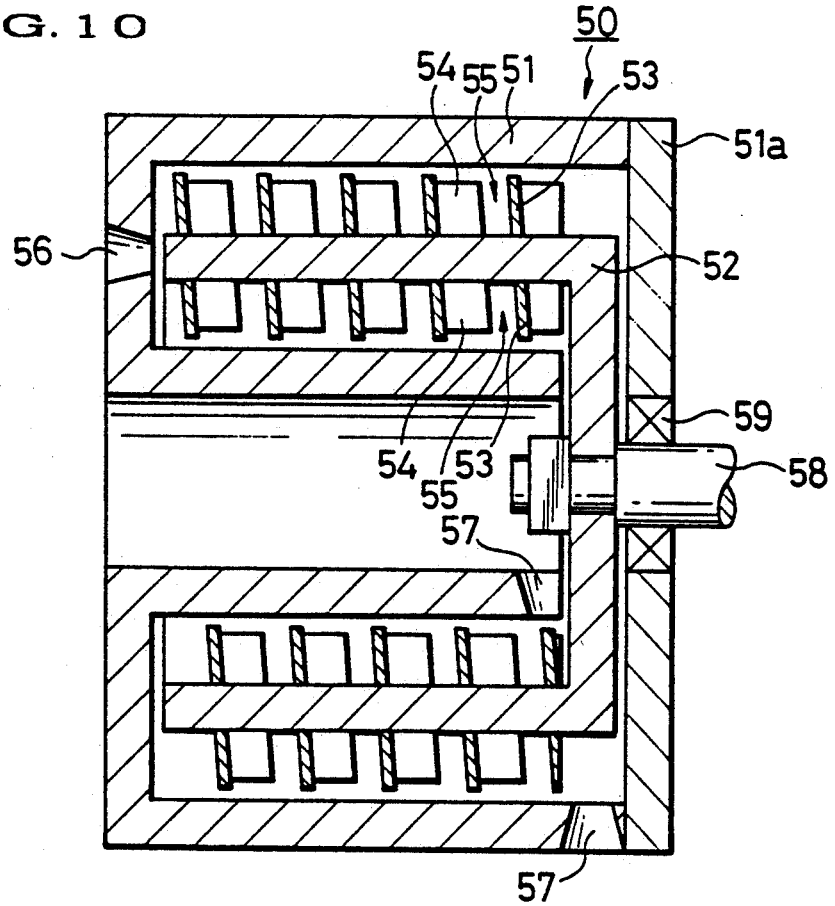

FIG. 10 shows a turbine 50 according to a further modification of a turbine of the above described embodiment. The turbine 50 has a tubular rotor 52, a helical partition 53 provided upright on the outer periphery of the rotor 52, plural blades 54 provided at a predetermined interval between turns of the partition 52, a spiral channel formed between the partition 53 and the blades 54 and, in addition, the same spiral partition 53, blades 54 and the spiral channel 55 on the inner periphery of the rotor 52. The casing 51 has a pouched structure for enclosing the rotor 52 therein, and an output shaft 58 of the rotor 52 is carried at a flange 51*a* by means of a bearing 59.

An inlet (nozzle) 56 for the working fluid is provided at the lateral end of the casing 51, with the working fluid being caused to flow from the end of the rotor 52 to both the channels 55, 55 on the outer and inner peripheries of the rotor 52. The discharge ports 57, 57 for the working fluid are provided in the casing 51 in register with the outer and inner peripheries of the proximal side of the rotor 52.

The inlet 56 and the discharge port 57 for the working fluid need not be limited to those shown in the drawing, if the working fluid may thereby be distributed to the channels 55, 55 on the inner and outer peripheries of the rotor 52 so as to be discharged from these channels 55, 55.

With the above turbine 50, the channels 55, 55 on the inner and outer sides of the rotor 52 are used, and hence the twofold volume of the working fluid may be used as the rotational force for the rotor 52, resulting in improved efficiency and compactness and a high performance, the turbine 50 may be of a multi-stage structure, as in the previously described turbine, for further improving compactness, efficiency and output.

Figure 11:
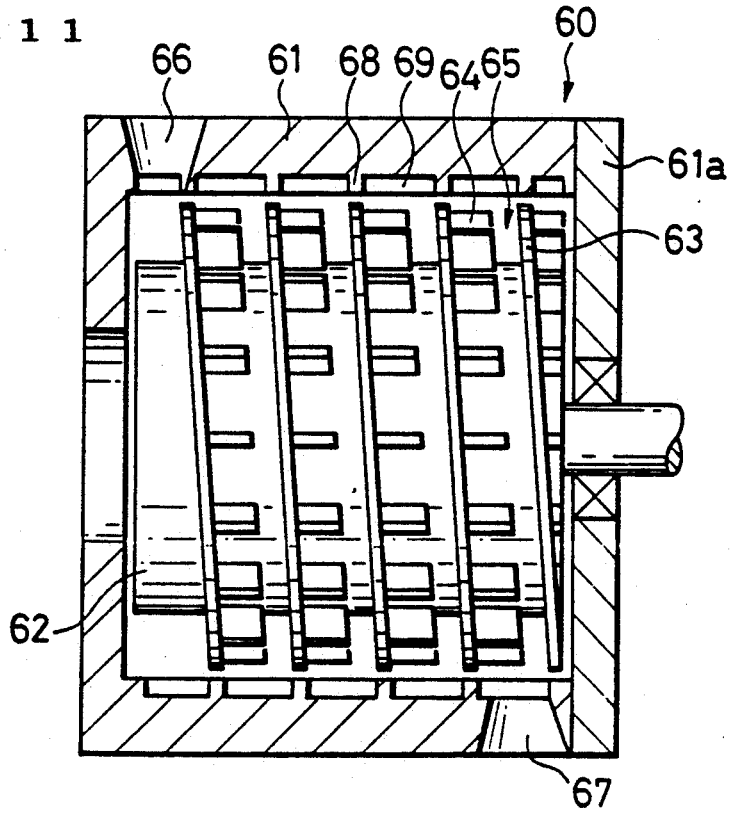

FIG. 11 shows a turbine 60 according to a further modification of the present embodiment. The turbine includes a spiral partition 63 provided on the outer periphery of the rotor 62, and, in register with a channel 65 delimited by blades provided at a predetermined interval between turns of the partition 63, a channel 69 (slot in a casing 61) delimited by a anti-helical (anti-screw) partition 68 provided on the inner periphery of the casing 61 (see FIG. 27). The casing 61 of the turbine 60 has a flange 61*a* and an inlet 66 and a discharge port 67 for the working fluid on both ends thereof.

With the above described turbine 60, since the channel 65 on the rotor 62 and the channel (slot) 69 on the casing 61 are anti-helical with respect to each other, the working fluid introduced into the nozzle 66 tends to be discharged to the opposite side by way of the channel 69 in the casing, whereas the working fluid introduced into the rotor 62 flows in the opposite direction, since the channel 65 is reversed with respect to the channel 69. Thus the pressure is augmented and the working fluid flows through channel 69 in the casing 61 to thrust the blades 64 to rotate the rotor 62. The working fluid then enters the channel 65 in the rotor 62 to enter again the channel 69 in the casing 61. This operational sequence is repeated to augment the capability of rotating the rotor 62 to increase the torque. This contrasts outstandingly to the conventional turbine in which, with the channel in the rotor and that in the casing extending in the same direction, the working fluid is sucked from the foremost part so that a counter torque acts on the blades and a hence a high torque cannot be produced.

In addition, since the channel 69 in the casing 61, which is anti-helical (anti-screw) with respect to the channel 65 on the rotor 62, also acts as a labyrinth seal, thereby decreasing the volume of the working fluid flowing out between the rotor 62 and the casing 61 to contribute to a higher efficiency.

It is to be noted that, with the above described turbine 60 as with the previously described turbines, the end face of the casing 61 on the opposite side of the flange 61*a* may be provided with a flange to provide for a hermetically sealed structure to prevent leakage of the working fluid to contribute to a still higher efficiency.

In each of the above described turbines, the turns of the partitions of the rotor and the turns of the partitions of the casing may be of a single spiral line or a plurality of spiral lines.

In the turbine of the above aspect, if the width of the channel of the casing becomes progressively narrow towards the foremost part of the casing, then the introduced working fluid may be used more efficiently. In addition, each of the turbines of this aspect may be of a multi-stage structure for improving performance.

Figure 14:
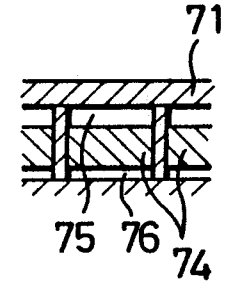
FIG. 14 is a view looking in the direction of arrows B—B of FIG. 13.
Figure 13:
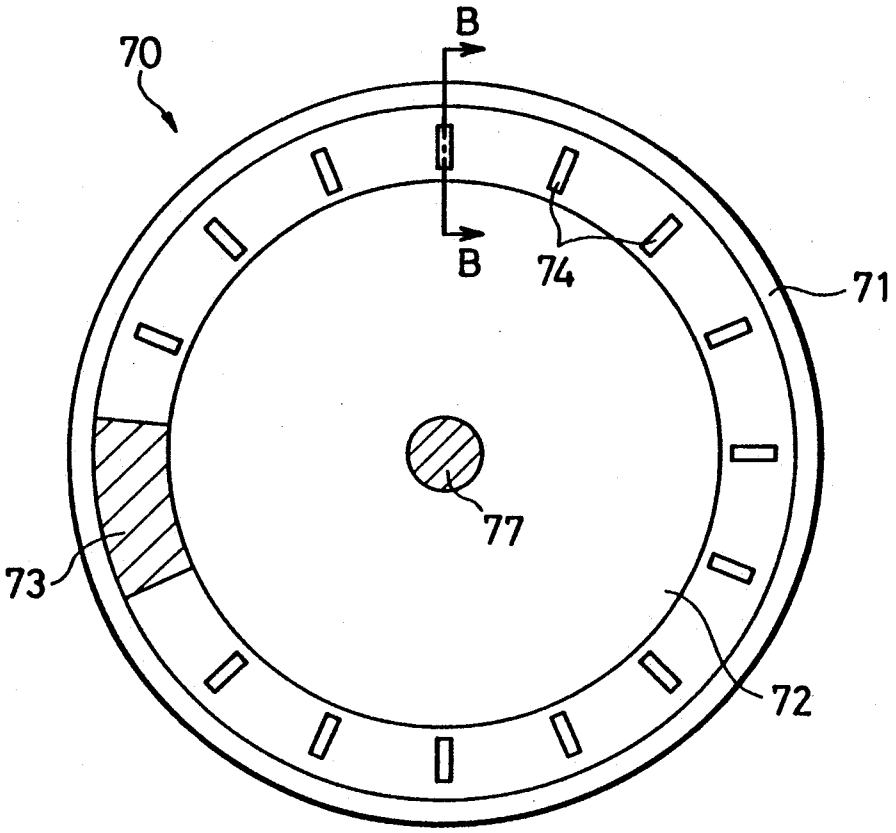
FIG. 13 is a transverse cross-sectional view thereof.
Figure 12:
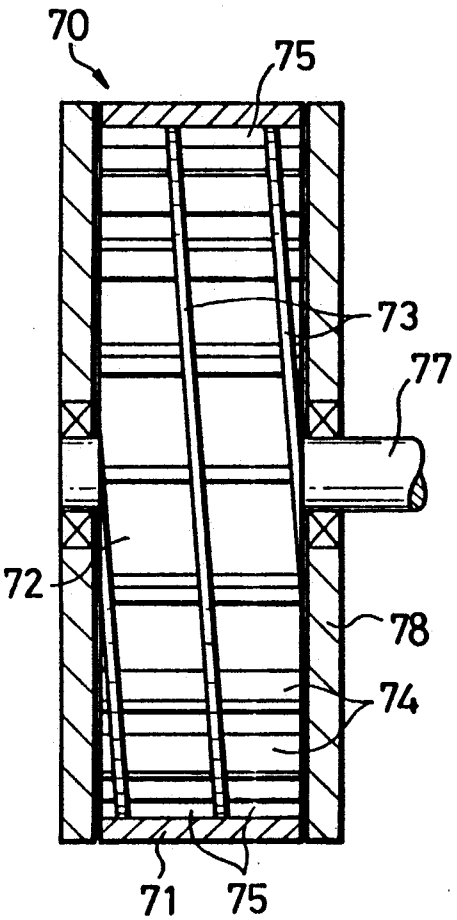
FIG. 12 is a partial longitudinal cross-sectional front view showing a further modification of a turbine according to the present invention.

FIGS. 12, 13 and 14 illustrate a turbine 70 according to a third embodiment of the present invention, wherein a tubular casing 71 and a rotor 72 are interconnected by a spirally extending partition 73 to form a spiral passageway, a plurality of blades 74 are mounted at a predetermined interval in the passageway, and wherein channels 75 and 76 are provided between the casing 71 and the rotor 71. the rotor 72 and the casing 71 are adapted to rotate in unison, and a stationary plate 78 carrying a rotational shaft 77 is provided at the inlet side of the channels with a suitable clearance with respect to the rotor 72. An inlet (nozzle), not shown, for injecting the working fluid into the channel, is provided on the stationary plate 78, while a discharge port, not shown, is provided at the outlet side of the channel.

Figure 15:
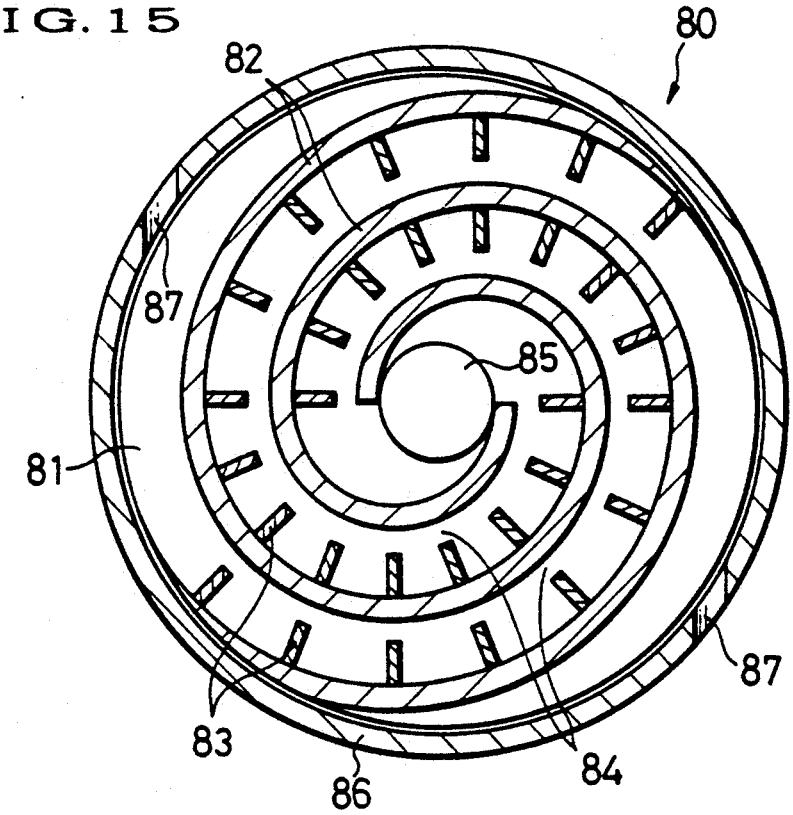
FIG. 15 is a transverse cross-sectional view of a still further modification of a turbine of the present invention.

FIG. 15 shows a turbine 80 according to a fourth embodiment of the invention, wherein a pair of disk-shaped side plates 81, 81 are interconnected by a spiral partition 82 to provide two turns of a helical passageway, blades or fins 83 are provided at a predetermined interval on one side thereof, a channel 84 is formed on the other side thereof, and a discharge port 85 communicating with the passageway is provided at the axial center of one of the side plates 81. The overall structure is mounted in a casing 86 for rotation therein. 87 in the drawing denotes an inlet.

In the present embodiment, the spiral passageway is delimited by the side plates and the partition. However, in a modification, the spiral passageway is delimited by integrally connecting a tube having a circular, rectangular or similar cross-sectional configuration in a convolute pattern.

Figure 16:
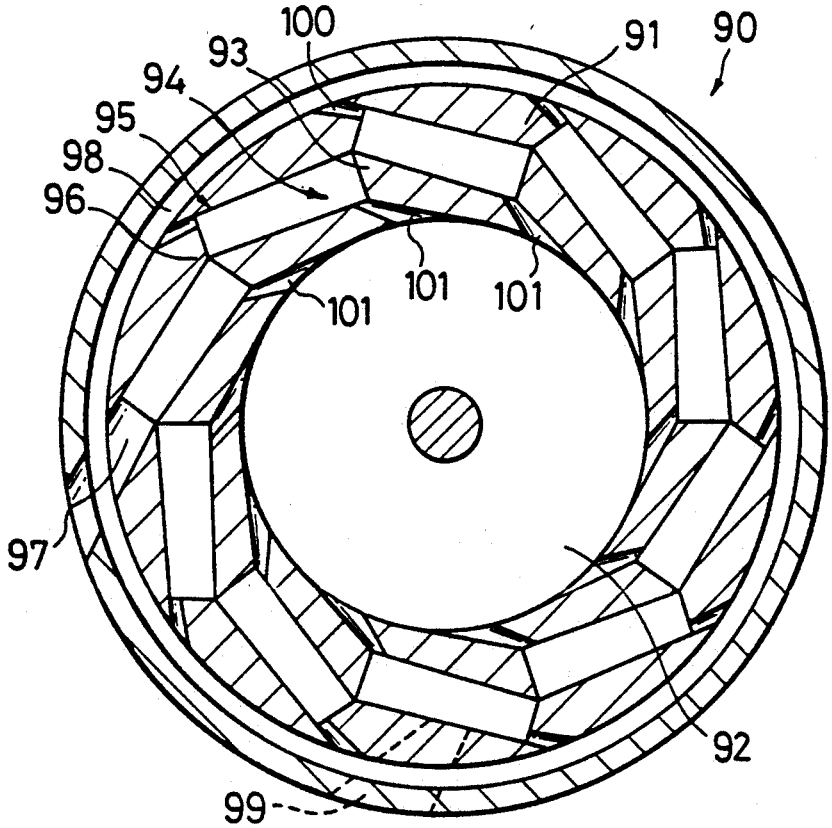
FIGS. 16 and 17 are transverse cross-sectional views showing another operating state of a further modification of a turbine according to the present invention.
Figure 17:
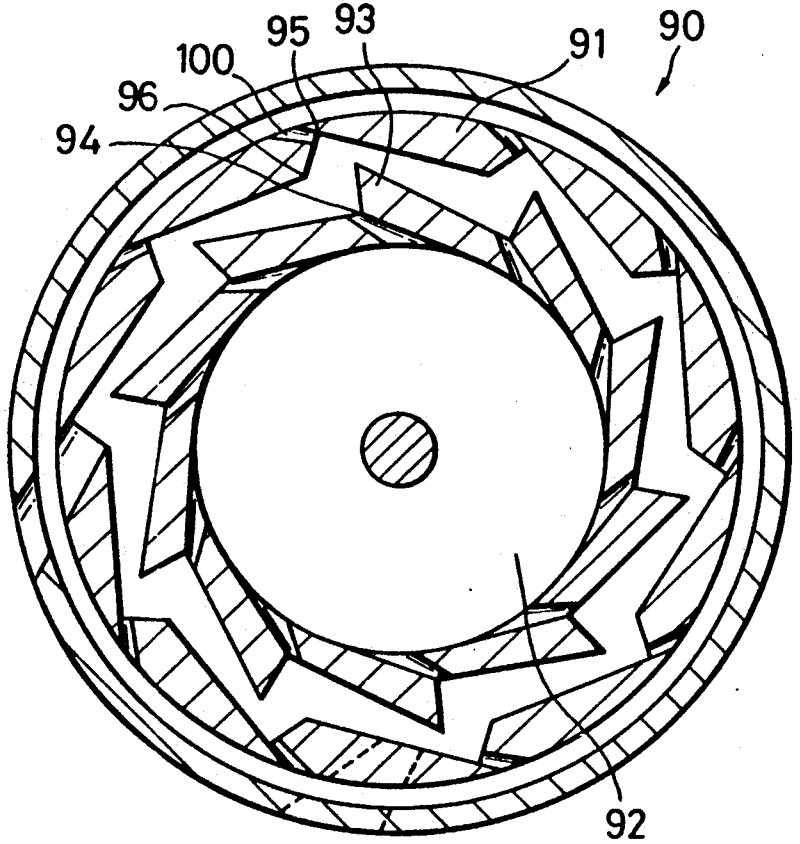

FIGS. 16 and 17 illustrate a turbine 90 according to a fifth embodiment of the present invention wherein serrations comprised of convex portions or blades 93 and concave portions 94 are formed on the outer periphery of a rotor 92. Vee grooves 95 are formed on the inner periphery of a casing 91 opening toward the concave portions 94 of the rotor 92. An annular duct 98 connecting to an inlet 97 is provided within the casing, and the working fluid is adapted to be injected from the duct 98 by way of a nozzle 100 for each vee groove 95 except the vee groove which is provided with a discharge port 99. If the turbine 90 is of a hermetically sealed structure, the rotor 92 may be formed as a cylinder and a rotor nozzle 101 connecting to the interior of the rotor may be provided for each concave portion 94.

In this manner, the working fluid is compressed with rotation of the rotor 92 and injected as a force of reaction from the rotor nozzle 101 so that an elevated pressure is established in the inside of the rotor 92. When a channel is formed between the rotor 92 and the casing 91, the working fluid is jetted in the reverse direction, that is from the interior into the channel, thereby increasing the rotational force of the rotor 92 to provide for a higher efficiency.

With the above turbine, as the rotor 92 is rotated and the convex portions 93 open toward the convex portions 96 defined by the vee grooves 95 on the inner periphery of the casing (FIG. 16), the static pressure prevailing in the space defined by the vee grooves 95 and the concave portions 94 is increased to rotate the rotor 92. When the convex portions 93 of the rotor 92 are offset from the convex portions 96 of the casing (FIG. 17), a channel connecting to a discharge port 99 is formed for discharging the working fluid.

Figure 18:
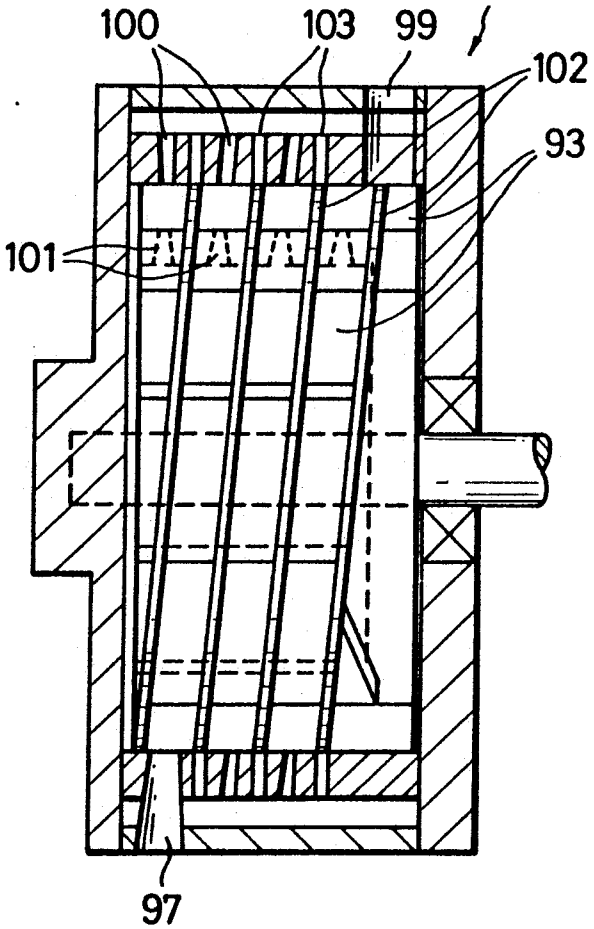
FIG. 18 is a longitudinal cross-sectional view showing a further modification of a turbine according to the present invention.

In another modification of the above embodiment, shown in FIG. 18, a partition 102 is formed spirally on the outer periphery of the rotor 92, and a partition 103 is also formed spirally on the casing 91, while convex and concave portions are provided between these spiral partitions. These spiral partitions may turn in reverse.

Figure 19A:
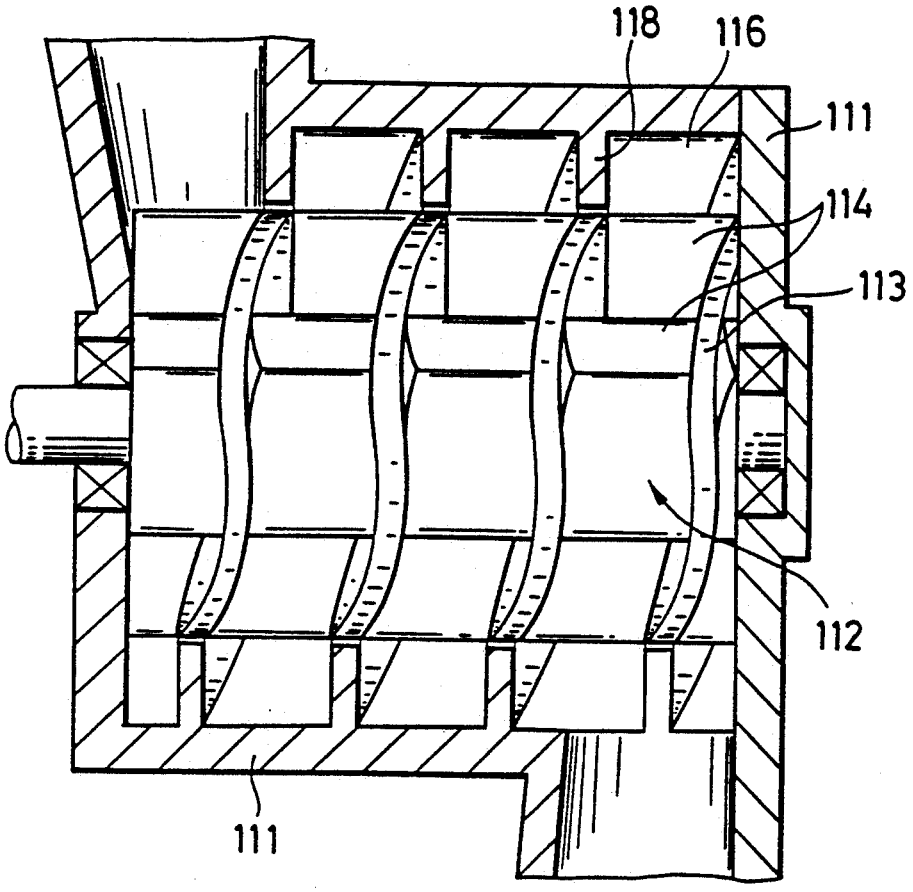
FIG. 19A is a view similar to FIG. 19 but showing the partition on the casing and the partition on the rotor as spirals of reverse direction from each other.
Figure 20:
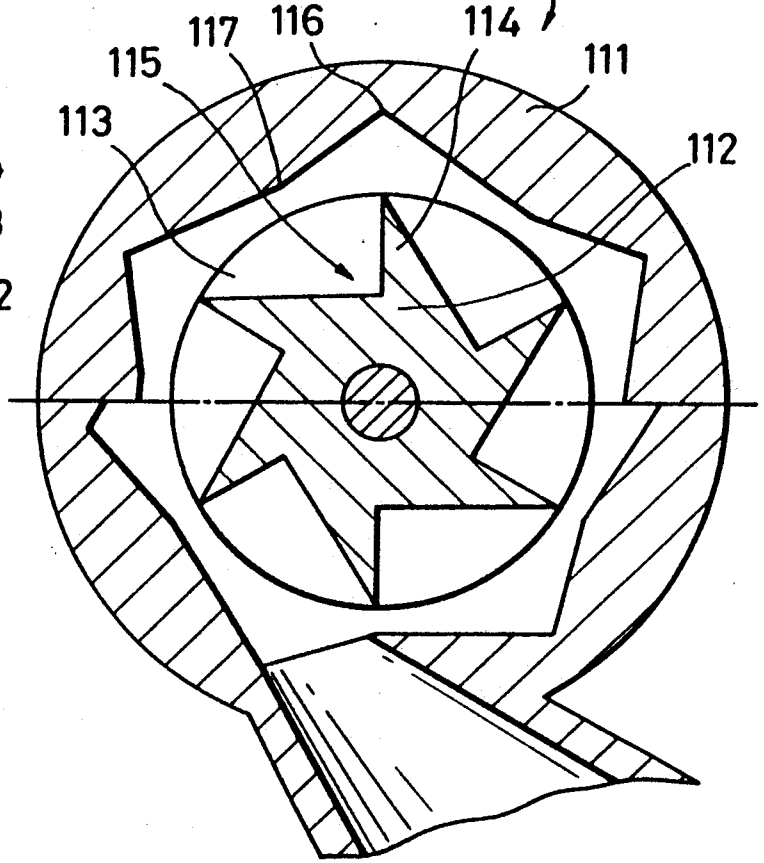
FIGS. 19 and 20 are a longitudinal cross-sectional view and a transverse cross-sectional view, respectively, showing collectively an upper half portion and a lower half portion of a further modification of a turbine according to the present invention for illustrating the different operating states thereof.
Figure 19:
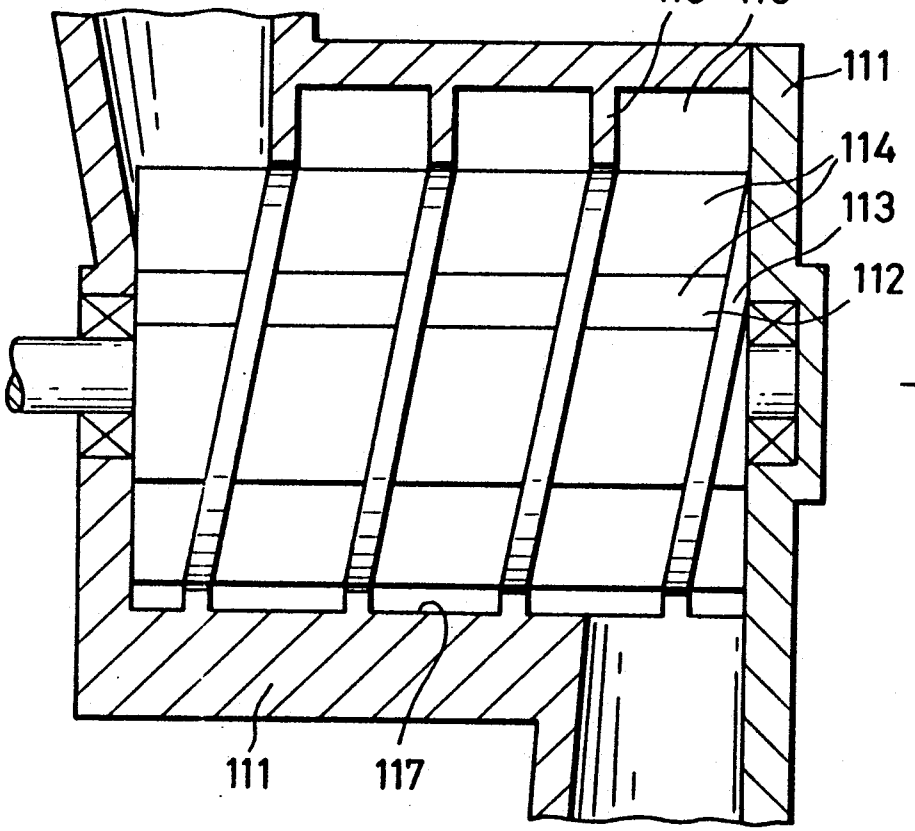

FIGS. 19 and 20 illustrate a turbine 110 in which a spiral passageway is defined by a partition 113 on the outer periphery of the rotor 112 and convex portions (blades) 114 and concave portions 115 in the form of serrations are provided on the outer periphery of the rotor 112 along this passageway. Vee grooves 116 are formed in the casing 111 between turns of the spiral partition 118 at the same pitch as the above passageway. With this turbine, the passageway on the casing 111 and that on the rotor 112 meet each other once for each complete revolution of the rotor 112 so that the convex portions 117 of the casing 111 may open toward the convex portions 114 of the rotor.

The upper half portions of FIGS. 19 and 20 illustrate the state in which the convex portions 114 of the rotor 112 are offset from the convex portions 114 of the casing 111 for defining a channel between the rotor 112 and the casing 111, whereas the lower half portions of FIGS. 19 and 20 illustrate the state in which the convex portions 114, 114 open toward each other to seal the passageways so that a rotational force is imparted by the working fluid to the convex, portions 114 of the rotor 112.

FIG. 19A is similar to FIG. 19 but shows the partition 113 and 118 as spirals of reverse direction from each other.

It is noted that, in the present embodiment, there is no limitation to the shape and the number of the convex portions and the concave portions formed on the outer periphery of the rotor and the casing. For example, the convex and concave portions may also be in the form of corrugations smoother in profile than serrations.

In the present embodiment, the partition on the rotor may be of the same pitch or interval as the channel or partition on the casing so that the channels or the partition on the rotor and the channel on the casing will face one another for each revolution of the rotor.

Alternatively, the channels or turns of the partition on the casing may be of a narrower width to provide a plurality of channels on the casing between each channel or the turn of the partition on the rotor to increase the number of times the turns of the partition on the rotor overlap with the turns of the partition on the casing to enhance the effects of labyrinth sealing. In these cases, the turns of the partition on the rotor are preferably of the same pitch as those of the partition on the casing.

Figure 21:
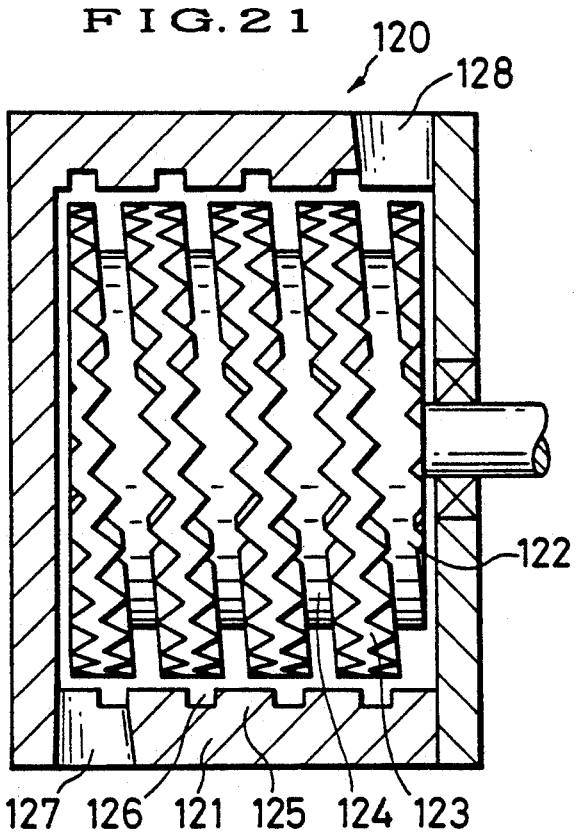
FIG. 21 is a cross-sectional view of a still further modification of a turbine according to the present invention.

FIG. 21 shows a turbine 120 according to a sixth embodiment of the present invention wherein zigzag-shaped slot partitions 123 are formed on the outer surface of a rotor 122 for defining zigzag-shaped partitions or slots 124 in the direction of the inner periphery, while the inner periphery of the casing 121 is formed with zigzag-shaped concave portions 125 of the same size as the slots 124 and channels or slots 126 on both sides of the convex portions 125 (see FIG. 28). The working fluid introduced by way of an inlet (nozzle) 127 is passed in the channels 124, 126 so as to be discharged by way of a discharge port 128. The channels 124 are stopped up or opened by the convex portions 125 with rotation of the rotor 122.

When the channels 124 on the rotor side are stopped by the convex portions 125, a pressure difference is caused between the channels 124 and 126, when the channels are offset with respect to the projections 125, the channels 124, 126 communicate with each other so that the working fluid flows into the channels 124 to cause rotation of the rotor 122.

The turbine 120 shown in FIG. 21 is also so constructed and arranged that the zigzag-shaped partition 123 and the channel 124 are formed in a spiral pattern on the outer periphery of the rotor 122, while the channel 126 of the same size as the channel 124 is formed on the inner periphery of the casing 121 between the zigzag-shaped convex portions 125, so that the channel 124 is in register with the convex portion 125 once for each revolution of the rotor 122, the channel 124 being then stopped by the convex portion 125.

Figure 22A:
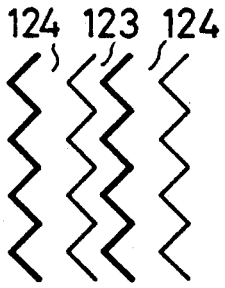
FIGS. 22*a*, 22*b*, 22*c* and 22*d* are diagrammatic views showing various patterns of partitions and channels.
Figure 22B:
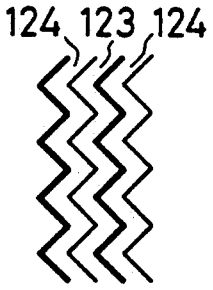
Figure 22C:
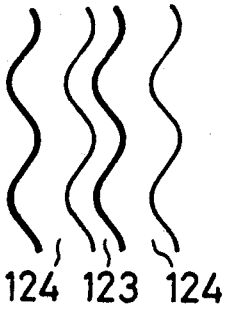
Figure 22D:
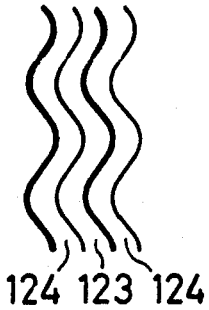
Figure 24:
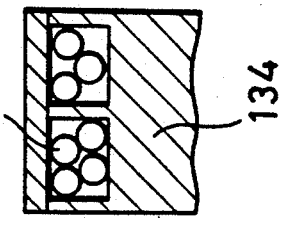
FIG. 24 is a diagrammatic view showing an embodiment of a blade employed in a turbocharger according to the present invention.

In the present embodiment, the pattern of the partition 123 and the channel 124 formed on the rotor 122 may be zigzag-shaped, as in FIGS. **22*a* and 22*b*, or in the form of smooth corrugations, as in FIGS. 22*c* and 22*d*. The partition 123 and the channel 124 may be the different widths, as shown in FIGS. 22*a* and 22*c*, or of the same width, as shown in FIGS. 22*b* and 22*d*. The pattern of the convex portions 125 and the channel 126 on the casing 121 may be of the same pattern as that of the rotor 122**.

FIG. 21 shows the zigzag-shaped channel 126 preferably formed in the inner periphery of the casing 121. However, there is no specific limitation of the turbine with respect to the channel according to this embodiment. The casing may be either with or without the groove to form the channel in its inner periphery. In case that the casing is provided with the channel, there are some modifications: the groove to be the channel may not be necessarily meandered; the channel may be a spiral or an anti-spiral form; and the width of the channel may be either constant or progressively narrow at the foremost part of the casing.

With the turbine 150, the inlet nozzle 156 is provided at the side of the drum 152, a discharged port 157 is formed at the outer side of the casing rotor 151, and the spiral channel 158 directing forward or reverse is formed at the outer periphery of the drum 152. In addition, a rotational shaft 159 fixed to the casing rotor 151 is carried with the drum 152 interposed between bearings 160,160 and with a support frame 161 which fixes and supports the drum 152.

Figure 25:
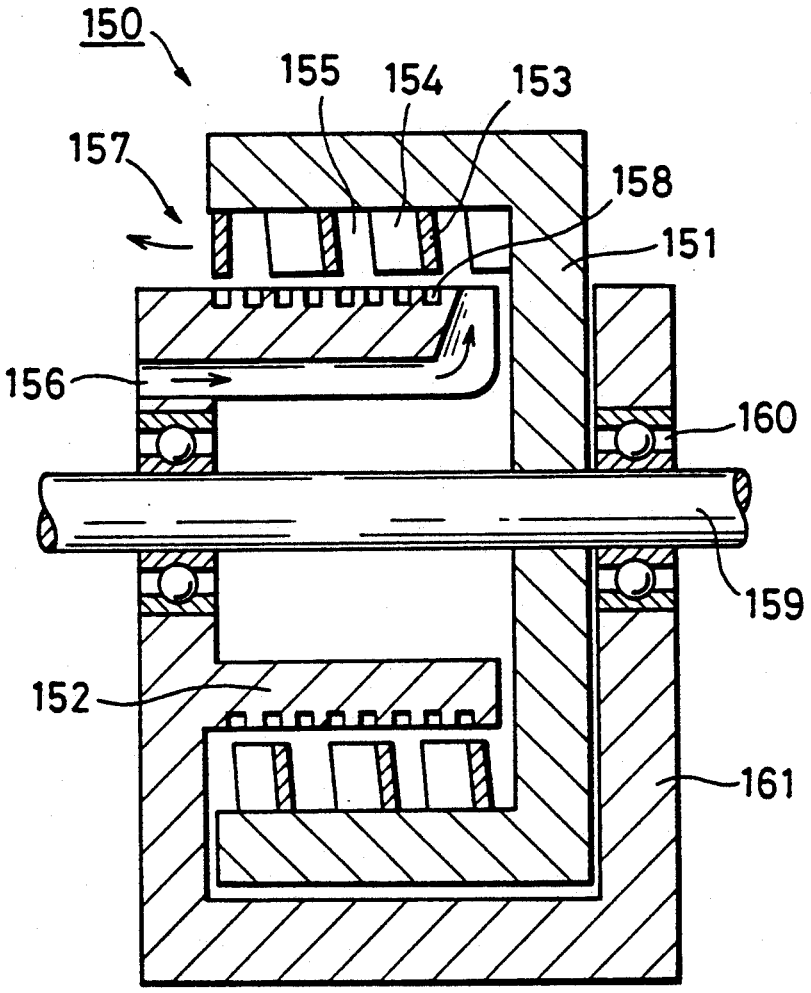
FIG. 25 is a cross-sectional view of a still further modification of a turbine according to the present invention.

The turbine 150 according to the seventh embodiment of the present invention is contrary to the pattern of the above mentioned embodiments in that, instead of rotating the rotor within the casing, the rotor is fixed as a drum 152 as shown in FIG. 25, and a casing-rotor 151 formed with partitions 153, blades 154 and the channels 155 is rotated about the drum.

Figure 23:
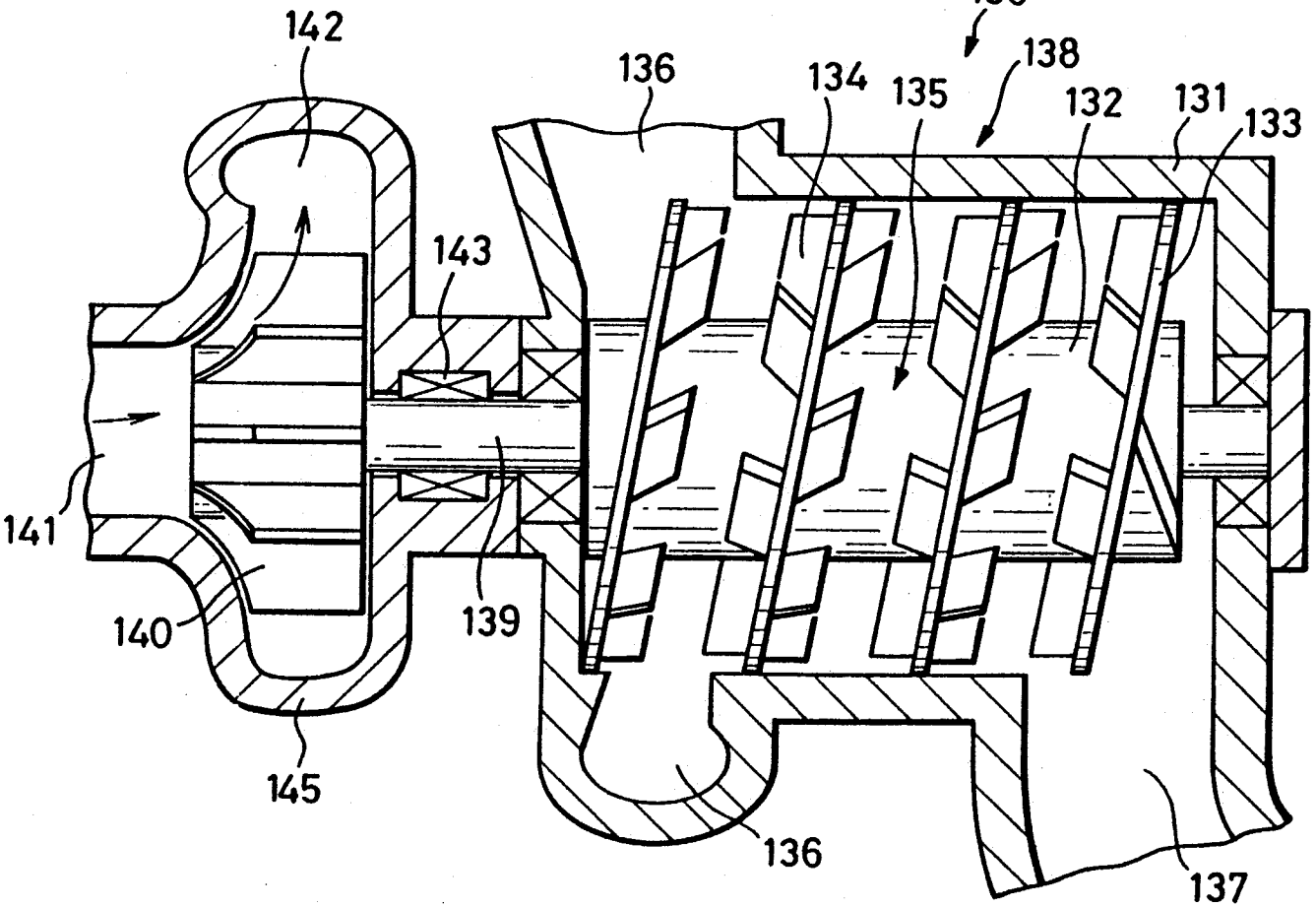
FIG. 23 is a longitudinal corss-sectional view of an embodiment of a turbocharger according to the present invention.

FIG. 23 shows a turbocharger 130 according to an eighth embodiment of the present invention, turbocharger is composed of a turbine 138 in which a spiral partition 133 is provided on the outer periphery of a rotor 132 rotating within a casing 131, blades 134 are provided between turns of the partition 133, a channel 135 is delimited between the blades 134 and the turn of the partition 133 and in which an inlet or nozzle 136 and a discharge port 137 communicating with an emission duct of an internal combustion engine, such as an automobile, are provided in the casing 131; a blower 140 mounted on one end of a rotational shaft 139 of the rotor 132 of the turbine 138; a casing 141 of the blower 140; an inlet 142 formed in the casing 141 for axially introducing air or charge; and a supply port which is provided radially and in communication with an engine suction pipe.

The casing 131 of the turbine 138 and the casing 141 of the blower 140 may be of a unitary structure. The rotational shaft 139 is supported by at least a bearing 143.

The turbine employed in the present turbocharger 130 may be any of the turbines shown in the above described embodiments of the invention and hence is not limited to that shown in the drawing.

The turbine 138 of the present invention may perform a high-torque rotation with high efficiency even with the low pressure, low speed and low flow rate working fluid, so that a sufficient supercharging can be performed even during the low speed rotation of the engine. Supercharging time lag of the turbocharger may also be reduced. On the other hand, even during high speed rotation of the engine, the turbine 138 may perform a high speed and high output rotation, so that a sufficient supercharging can be realized.

Therefore, contrary to the conventional turbocharger, there is no necessity of loading two turbochargers, that is a turbocharger for low pressure application and a turbocharger for high pressure application, for using them for separate purposes. When it is especially desired to use them for separate purposes, one of the two turbochargers may be the inventive turbocharger and the other the conventional one, or may both be the inventive turbochargers.

The performance of the turbocharger may be adjusted as a function of the size of the channel 135 or of the shape, size and the number of the blades 134.

With the turbocharger 130 of the present invention, the component material of the turbine 138, especially the material of those portions or components in contact with the emission gases as the working fluid, such as the partition 133, blades 134, the outer peripheral surface of the rotor 132 or the inner peripheral surface of the casing 131, are preferably formed of a material exhibiting a catalytic function for processing emission gases.

Among these catalytic materials, there are heavy metals, such as platinum (Pt), rhodium (Rh), ruthenium (Ru) or palladium (Pd), copper-nickel alloys, oxides of transition metals, such as copper (Cu), chromium (Cr), nickel (Ni) or manganese (Mn), or catalysts consisting of oxides of copper or chromium supported on alumina particles.

Although the above mentioned portions or components may be directly composed of the above mentioned materials, a particulate catalyst 144 may also be arranged or embedded at a suitable position on the channel 135, or arranged at an area capable of contacting with emission gases.

By so doing, not only the engine emission gases may be cleaned, but the supercharging efficiency of the turbocharger may be increased, since the combustion heat generated by the combustion of carbon monoxide (CO), unburned hydrocarbons (HC) and nitrogen oxides (NOx) in the emission gases may be used as the energy for turbine 138.

As described above, the turbine made of the catalytic materials may be adapted to the gas turbine.

The present invention, constructed as described above, gives the following effects.

With the turbine of the present invention, as contrasted to the aforementioned turbine in which spiral grooves are formed on both the outer periphery of the rotor and the inner periphery of the casing, the major portion of the working fluid flows on the rotor side and, due to the reduced frictional resistance with the casing, the energy proper to the working fluid is effectively utilized for rotating the rotor to enhance the rotational torque. In addition, since there is no necessity of machining the spiral groove, for example, on the casing, the construction may be simplified with reduction in costs.

With the turbine of the present invention, since the working fluid is discharged after travelling several times around the rotor, the opposition from the blades due to the frictional resistance is increased to make it possible to utilize the energy proper to the working fluid more effectively.

With the turbine of the present invention, the flow of the working fluid is directed towards the blades to increase the opposition from the blades due to frictional resistance as well as to prevent reversal of the working fluid.

With the turbine of the present invention, since the casing is unified with the rotor, the frictional resistance with the casing contributes to rotor rotation to enhance the rotational force of the rotor for further improving the efficiency.

With the turbine of the present invention, the frictional resistance with the working fluid contributes in its entirety to the rotational force of the rotor for effective utilization of the working fluid proper to the working fluid.

With the turbine of the present invention, fitted with a guide plate, the rotational force of the rotor may be increased, while cooling effects for the turbine may be achieved simultaneously.

With the turbine of the present invention, various rotating elements, such as grinding or cutting edges or abrasive wheels, may be directly attached to a rotating outer casing for performing rotational machining operations.

With the turbine of the present invention, the introduced working fluid may be used efficiently and the energy of the working fluid may be converted efficiently into the rotational force of the rotor.

With the turbocharger of the present invention, sufficient supercharging can be achieved even during low speed rotation of the engine, while highly efficient supercharging may be achieved with cleaning of the emission gases.

EXAMPLE

A steel-made turbine having the structure of the second aspect of the present invention, shown in FIG. 5, was prepared. Using a compressor, pressurized air of 5.2 $kg/cm^2G$ gauge pressure was used to measure rotating speed and torque of this turbine.

Dimensions of the turbine was set to 114 mm outer diameter of rotor, 43 mm width of rotor and 12 mm pitch of channel with a three-round spiral, and the inner periphery of the casing without channel (groove).

The result of the rotating speed measurement is shown below..

| | | |
|---|---|---|
| Pressure ($kg/cm^2G$) | 0.5 | 1 |
| Rotating speed (rpm) | 2700 | 4000 |

Note: No measurement of 4000 more rpm was made.

The result of the torque measurement is shown below.

Figure 26:
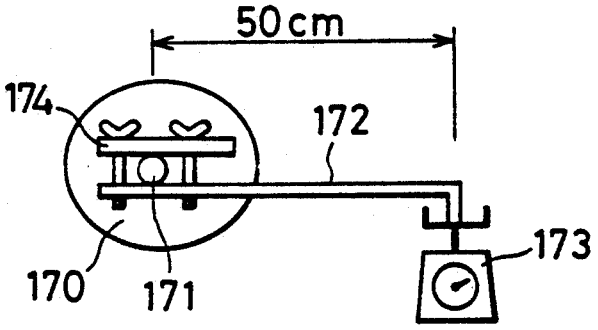
FIG. 26 is a diagrammatic construction showing torque meter using the example of the present invention.

The torque shaft of the turbine was measured by using the structure shown in FIG. 26. A rotating shaft 171 of a turbine 170 was forced onto a supporting shaft 172 by means of a push plate 174, giving a moment to the support shaft 172. Using a load meter 173, the load test was performed at the point 50 cm apart from the center of the rotating shaft 171. The torque shaft of the turbine was observed by measuring push pressure of the supporting shaft 172.

At this time, the turbine was driven with the pressure and flow of working fluid as follows.

| | | | | |
|---|---|---|---|---|
| Compressor pressure: | | 5.2 kg/cm$^2$ | | |
| Flow of pressurized air: | | 0.528 Nm$^3$/min | | |
| Rotating speed (rpm) | 0 | 300 | 1500 | 3000 |
| Torque (g · cm) | 2000 | 1850 | 1800 | 1600 |

What is claimed is:

1. A turbine comprising a casing, at least one spiral partition projectingly formed along the inner periphery of said casing, a plurality of concave portions formed at a suitable interval on the inner periphery between adjacent turns of said partition, a rotor rotatably carried within said casing, at least one spiral partition projectingly formed along the outer periphery of said rotor, a plurality of blades formed by a plurality of concave portions provided at a suitable interval on the outer periphery of said rotor between adjacent turns of said partition, an inlet formed in said casing for introducing a working fluid into said casing and an outlet formed in said casing for discharging said working fluid out of said casing.

2. A turbine according to claim 1 wherein the spiral partition of the casing and the spiral partition of the rotor are the reverse direction each other.

3. A turbine according to claim 1 wherein said casing is further provided with a plurality of nozzles for flowing said working fluid to said blades.

4. A turbine according to claim 1 wherein the width of a channel defined between adjoining turns of partition of said casing is equal to the width of the partition of said rotor.

5. A turbine according to claim 1 wherein the partition of said casing is of the same shape as the partition of said rotor.

* * * * *